US005274869A

United States Patent [19]

Hung

[11] Patent Number: 5,274,869

[45] Date of Patent: Jan. 4, 1994

[54] AUTOMATIC CHALK ASH CLEANER

[76] Inventor: Ying-Tu Hung, 9F-3, No. 218, Kuo Kuang Rd., Taichung, Taiwan

[21] Appl. No.: 42,281

[22] Filed: Apr. 2, 1993

[51] Int. Cl.[5] ..... A46B 13/02

[52] U.S. Cl. ..... 15/21.1; 15/88.4

[58] Field of Search ..... 15/21.1, 98, 91, 88.4, 15/303, 310, 311, 246, 141.1, 141.2, 142

[56] References Cited

U.S. PATENT DOCUMENTS 1,483,667 2/1924 Landreth et al. ..... 15/88.4
1,552,713 9/1925 Leary ..... 15/310 X
1,619,899 3/1927 Ward ..... 15/142
1,802,587 4/1931 Tavender et al. ..... 15/311 X
3,246,754 4/1966 Sackett ..... 15/21.1
4,392,268 7/1983 Bueno ..... 15/91

*Primary Examiner*—Edward L. Roberts
*Attorney, Agent, or Firm*—Morton J. Rosenberg; David I. Klein

[57] ABSTRACT

Disclosed is an automatic chalk ash cleaner including an elongated casing horizontally fastened to a blackboard at the bottom and covered with a wire netting cover, a brush assembly driven by a power drive through a transmission mechanism to sweep chalk ash away from the erasers placed on the wire netting cover and to sweep out fallen chalk ash.

6 Claims, 3 Drawing Sheets

AUTOMATIC CHALK ASH CLEANER

BACKGROUND OF THE INVENTION

The present invention relates to a chalk ash cleaner which is fastened to a blackboard and driven to remove chalk ash from the blackboard and the erasers automatically.

In schools, chalks are commonly used for writing things or drawing patterns on a blackboard. Whiling writing on a blackboard with a chalk or hitting a chalk mark eraser against an object to shake off chalk ash, chalk ash may move with the wind, causing the teacher and the students to suck in chalk ash.

SUMMARY OF THE INVENTION

The present invention has been accomplished under the aforesaid circumstances. It is therefore the main object of the present invention to provide an automatic chalk ash cleaner which automatically sweeps chalk ash away from erasers and simultaneously sweeps out fallen chalk ash. According to the first embodiment of the present invention, the automatic chalk ash cleaner comprises a conveying belt driven by a motor to carry bristles around a line of rollers within a wire netting covered casing so as to remove chalk ash from erasers being placed above and simultaneously to sweep out fallen chalk ash. According to the second embodiment of the present invention, a spiral brush assembly is fastened around a revolving shaft along its length and driven by a motor to rotate within the casing so as to sweep out chalk ash.

DETAILED DESCRIPTION OF THE PREFERRED EMBODIMENTS

Figure 1:
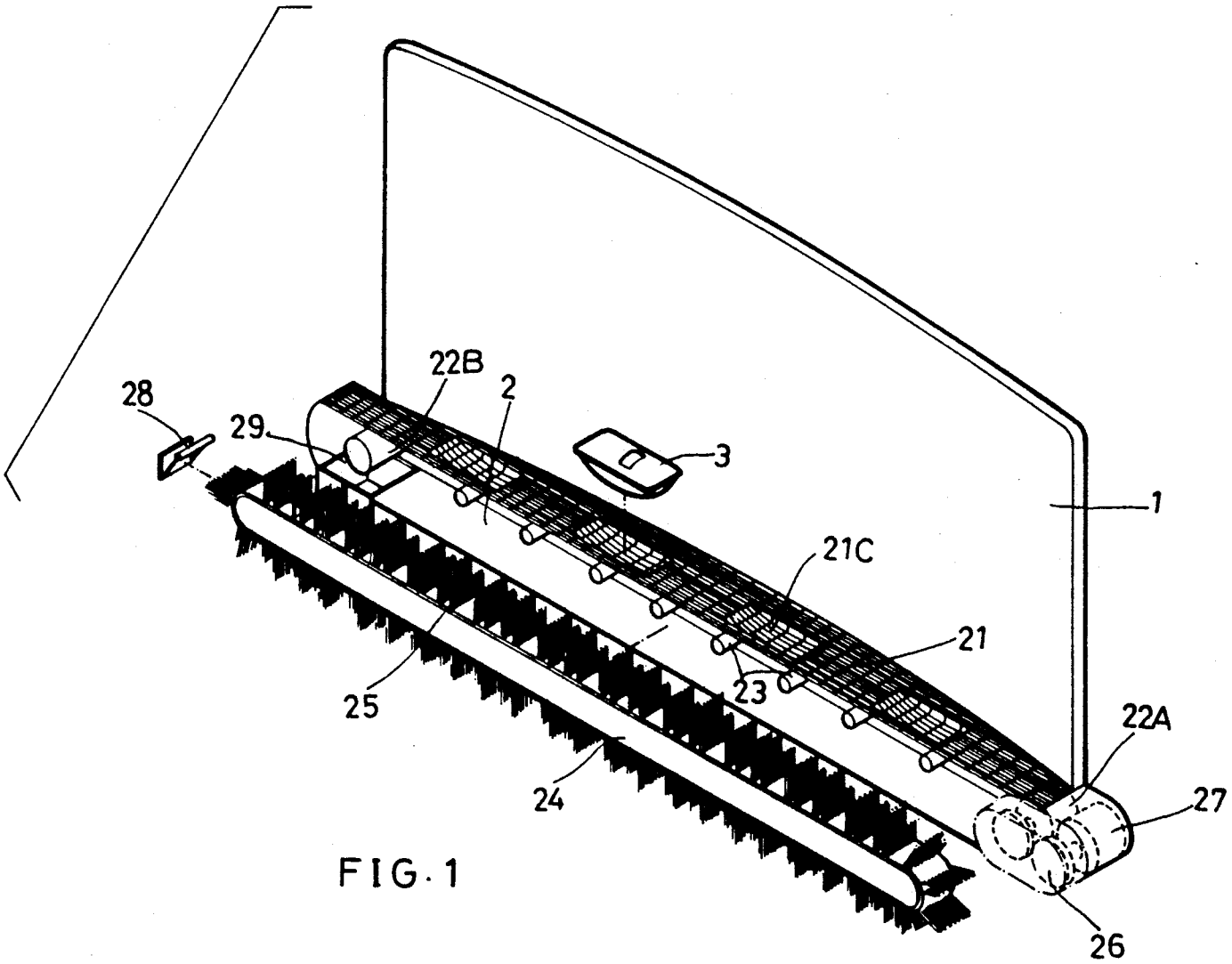
FIG. 1 is a perspective exploded view of an automatic chalk ash cleaner constructed according to a first embodiment of the present invention.

Referring to FIG. 1, an automatic chalk ash cleaner constructed in accordance with a first embodiment of the present invention is generally comprised of an elongated casing 2 fastened to a blackboard 1 at the bottom horizontally. The casing 2 is relatively longer than the width of the blackboard 1 so that chalk ash can be completely collected and swept out. The casing 2 has a top opening covered with a wire netting cover 21. A plurality of recessed portions 21 are formed on the wire netting cover 21 for holding erasers 6. The shape of the recessed portions 21 fits over the erasing surface of the erasers 6. On the inside of the casing 1 there are a first cylinder 22A and a second cylinder 22B transversely disposed at two opposite ends, and a plurality of rollers 23 transversely spaced between the cylinders 22A;22B. An endless conveying belt 24 is mounted on the cylinders 22A;22B around the rollers 23. Bristles 25 are perpendicularly fastened around the endless conveying belt 24 on the outside. The bristles 25 include firm bristles and soft bristles alternatively arranged around the endless conveying belt 24, and the firm bristles are shorter than the soft bristles. The length of the bristles 25 should be longer than the pitch between the endless conveying belt 24 and the top surface of the recessed portions 21C. A bumper 28 is fastened inside the casing 2 at one end. An ash pan 29 is fastened to the casing 2 below the bumper 28 and the second cylinder 22B to collect chalk ash. A speed reducer 26 is coupled to the first cylinder 22A and driven to rotate it by a motor 27.

Figure 2:
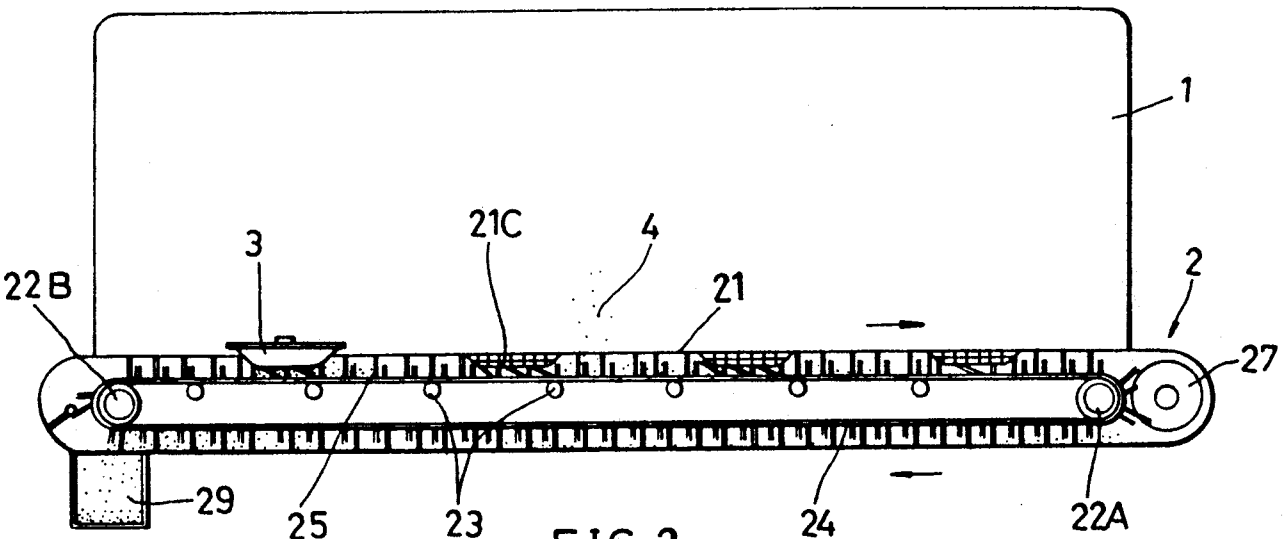
FIG. 2 is a plan view showing the operation of the automatic chalk ash cleaner of FIG. 1 in sweeping out chalk ash.

Referring to FIG. 2, turning on the motor 27 causes the speed reducer 26 to rotate the first cylinder 22A in turning the endless conveying belt 24. As the endless conveying belt 24 is turned around the rollers 23, the bristles 25 are carried to sweep chalk ash away from the erasers 3 being placed in the recessed portions 21C, and simultaneously and continuously to sweep fallen chalk ash away from the bottom of the casing 2 to the ash pan 29. While passing through the bumper 28, chalk ash in the bristles 25 is shaken down and falls to the ash pan 29.

Figure 4:
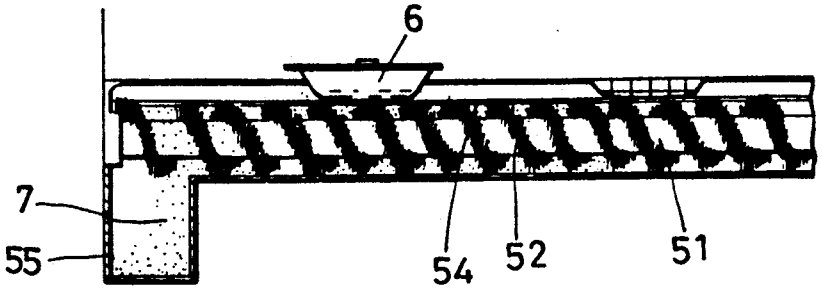
FIG. 4 is a plan view showing the operation of the automatic chalk ash cleaner of FIG. 3 in sweeping out chalk ash.
Figure 3:
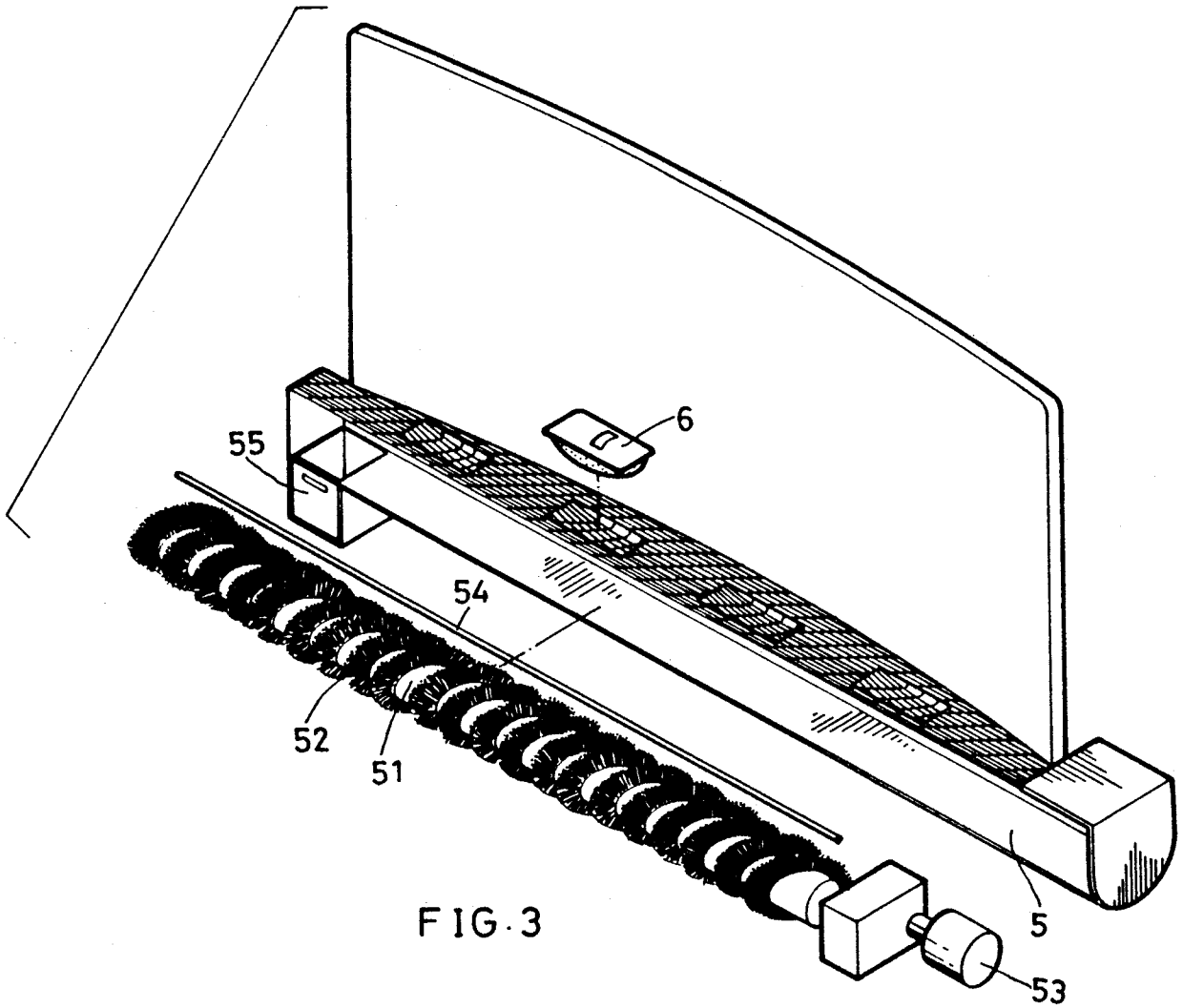
FIG. 3 is a perspective exploded view of an automatic chalk ash cleaner constructed according to a second embodiment of the present invention.

Referring to FIGS. 3 and 4, therein illustrated is an alternate form of the automatic chalk ash cleaner made according to a second embodiment of the present invention. In this alternate form, a spiral brush assembly 52 is fastened around an elongated revolving shaft 51 along its length. The revolving shaft 51 is driven by a motor and reducing gear set 53 to sweep out chalk ash and move it to an ash pan 55 at the rear end of the casing 5.

While only a few embodiments of the present invention have been shown and described, it will be understood that various modifications and changes could be made without departing from the spirit and scope of the invention.

What is claimed is:

1. An automatic chalk ash cleaner comprising an elongated casing fastened to a blackboard at the bottom in a horizontal position to collect fallen chalk ash, said casing having a top opening covered with a wire netting cover, said wire netting cover having a plurality of recessed portions, each recessed portion fitting over the erasing surface of a chalk mark eraser, a brush assembly driven by a power drive through a transmission mechanism to turn in a fixed course so as to sweep chalk ash away from chalk mark erasers being placed in said recessed portions and from said casing, and an ash pan fastened to said casing to collect chalk ash removed by said brush assembly.

2. The automatic chalk ash cleaner of claim 1 wherein said transmission mechanism comprises two cylinders transversely fastened inside said casing at two opposite ends, a plurality of rollers spaced between said cylinders, an endless conveying belt mounted on said cylinders around said rollers and driven by said power drive through said cylinders to carry said brush assembly in said fixed course.

3. The automatic chalk ash cleaner of claim 2 wherein said brush assembly comprises firm bristles and soft bristles alternatively arranged around said endless conveying belt, said firm bristles being shorter than said soft bristles.

4. The automatic chalk ash cleaner of claim 1 which further comprises a bumper fastened inside said casing to shake chalk ash from said brush assembly as said brush assembly is moved in said fixed course.

5. The automatic chalk ash cleaner of claim 1 wherein said transmission mechanism is an elongated revolving shaft fastened inside casing longitudinally.

6. The automatic chalk ash cleaner of claim 5 wherein said revolving shaft is fastened with a spiral brush assembly around its outside wall along its length.

* * * * *